US006024008A

United States Patent [19]

Kawaguchi et al.

[11] Patent Number: 6,024,008

[45] Date of Patent: Feb. 15, 2000

[54] VARIABLE DISPLACEMENT COMPRESSOR, SWASH PLATE, AND METHOD FOR HARDENING SWASH PLATE

[75] Inventors: Masahiro Kawaguchi; Hiroyuki Nagai; Masanori Sonobe; Yoshihiro Makino; Shintaro Miura, all of Kariya, Japan

[73] Assignee: Kabushiki Kaisha Toyoda Jidoshokki Seisakusho, Kariya, Japan

[21] Appl. No.: 08/972,647

[22] Filed: Nov. 18, 1997

[30] Foreign Application Priority Data

Nov. 22, 1996 [JP] Japan ..... 8-312308
Feb. 25, 1997 [JP] Japan ..... 9-041078

[51] Int. Cl.[7] ..... F01B 3/00; F01B 13/04

[52] U.S. Cl. ..... 92/12.2; 92/71; 91/505

[58] Field of Search ..... 92/70, 71, 12.2; 91/499, 505, 506

[56] References Cited

U.S. PATENT DOCUMENTS

| | | | |
|---|---|---|---|
| 5,636,561 | 6/1997 | Pecorari | 91/499 |
| 5,699,716 | 12/1997 | Ota et al. | 92/12.2 |
| 5,722,310 | 3/1998 | Ota et al. | 92/12.2 |
| 5,862,704 | 1/1999 | Seljestad | 91/499 X |

FOREIGN PATENT DOCUMENTS

| | | |
|---|---|---|
| 19528910 A1 | 2/1996 | Germany . |
| 8159022 | 6/1996 | Japan . |
| 590199 | 7/1947 | United Kingdom . |

OTHER PUBLICATIONS

Patent Abstracts of Japan, 08334081, Dec. 17, 1996.
Patent Abstracts of Japan, 07167043, Jul. 4, 1995.
Patent Abstracts of Japan, 05009559, Jan. 19, 1993.

*Primary Examiner*—John E. Ryznic
*Attorney, Agent, or Firm*—Morgan & Finnegan, LLP

[57] ABSTRACT

A variable displacement type compressor having a piston accommodated in a cylinder bore, a swash plate accommodated in a crank chamber for reciprocating the piston and a drive shaft for tiltably and rotatably supporting the swash plate. The swash plate includes projections that extend toward a thrust bearing and have outer surfaces that contact the thrust bearing. A shaft hole within which the drive shaft is located between the projections. The shaft hole has an opening that opens adjacent to the projections. A recess is formed at the end of the shaft hole adjacent to the projections. A hardening method is performed on the wall of the through hole and on the outer surfaces of the projections to improve wear resistance. The hardening method prevents overheating of localized areas of the swash plate.

9 Claims, 4 Drawing Sheets

VARIABLE DISPLACEMENT COMPRESSOR, SWASH PLATE, AND METHOD FOR HARDENING SWASH PLATE

BACKGROUND OF THE INVENTION

The present invention relates to variable displacement compressors, such as that used in an automobile air-conditioning apparatus, swash plates, and methods for hardening the swash plates.

Japanese Unexamined Patent Publication No. 8-159022 describes a typical variable displacement type compressor. The compressor has a housing that houses a crank chamber and rotatably supports a drive shaft. The drive shaft is connected to an external drive source such as an automobile engine. A clutch connects the drive shaft to the external drive source. The housing includes a cylinder block, which is provided with a plurality of cylinder bores. A single-headed piston is reciprocally accommodated in each cylinder bore.

A swash plate, which serves as a cam plate, is provided on the drive shaft and supported so that it inclines with respect to the drive shaft while rotating integrally with the drive shaft. The swash plate is coupled to each piston. A central bore is defined in the cylinder block. The central bore is connected to a suction passage, which draws refrigerant gas into a suction chamber from an external refrigerant circuit. A spool is accommodated in the central bore to open and close the suction passage in cooperation with the inclination of the swash plate. A hole extends through the swash plate. The drive shaft is inserted through the hole in the swash plate. A thrust bearing is arranged between the spool and the swash plate. The wall of the swash plate hole contacts the outer surface of the drive shaft and the rear surface of the swash plate abuts against the spool during inclination of the swash plate.

A displacement control valve is provided in either the suction chamber or a discharge chamber. The control valve changes the pressure of the crank chamber. The difference between the pressure of the crank chamber and the pressure in the cylinder bores varies the displacement of the compressor.

When the swash plate inclines, the swash plate slides along the drive shaft and the spool. Thus, abrasion occurs during the sliding. To resist the abrasion, part of the swash plate undergoes an induction hardening treatment. As shown in FIGS. 7(*a*) and 7(*b*), the swash plate 91 has projections 92 extending from two sides of the hole 93. When the swash plate 91 is fitted on the drive shaft, the projections 92 face toward a spool. A hole 93 extends through the center of the swash plate 91. The drive shaft is inserted through the hole 93. The hardening treatment is carried out on the wall of the hole 93 and on the surfaces of the projections 92.

Induction hardening is performed by inserting a coil 94 into the hole 93, as shown in FIG. 7(*a*).

However, hardening of the swash plate 91 in this manner causes the heating of the surfaces of the projections 92 to be inferior to that of the wall of the hole 93. This may result in the surfaces of the projections 92 having inferior durability due to insufficient hardening. Furthermore, the hardening of the surfaces of the projections 92 to an optimal state results in excessive heating of the wall of the hole 93. This may lead to cracking or melting of the wall of the hole 93. It may also lead to undesirable deformation of the hole 93.

These problems may be dealt with by providing another coil for the surface of the projection 92. However, this would cause excessive heating of the corner, or edge, between the wall of the hole 93 and the surfaces of the projections. In this case, the edge may crack or melt.

SUMMARY OF THE INVENTION

Accordingly, it is an objective of the present invention to provide a variable displacement compressor capable of improving the durability of the swash plate and, as a result, the durability of the compressor itself.

It is another objective of the present invention to provide a swash plate that enables sufficient hardening without cracking or melting when the surface of the swash plate, subject to abrasion, undergoes a hardening treatment.

A further objective of the present invention is provide a method for hardening the swash plate in an optimal manner.

To achieve the above objectives, in a first aspect of the present invention, a variable displacement type compressor is provided. The compressor has a piston accommodated in a cylinder bore, a cam plate accommodated in a crank chamber for reciprocating the piston, and a drive shaft for tiltably and rotatably supporting the cam plate. The compressor performs suction of a gas from a suction chamber, compression of the gas in the cylinder bore, and discharging of the gas to a discharge chamber in accordance with a reciprocation of the piston. The compressor changes a discharge amount of the gas by changing the inclination angle of the cam plate based on pressure differences between the pressure in the crank chamber and the pressure in the cylinder bore. The compressor includes a thrust bearing located about the drive shaft for receiving a load from the cam plate. The cam plate includes a projection that extends toward the thrust bearing. The projection has an abutment surface that contacts the thrust bearing. The cam plate further includes a shaft hole within which the drive shaft is located. The shaft hole has an opening that opens adjacent to the projection. A recess is formed in the wall of the shaft hole adjacent to the opening. A hardening treatment is performed on the wall of the shaft hole and on the outer surface of the projection to improve wear resistance.

In a second aspect of the present invention, a cam plate for a compressor is provided. The compressor has a drive shaft. The cam plate is supported tiltably on the drive shaft for reciprocating a piston in accordance with a rotation of the drive shaft. The compressor also has a thrust bearing for receiving a load from the cam plate. The cam plate includes a projection that extends toward the thrust bearing. The projection has an abutment surface that contacts the thrust bearing. The cam plate further includes a shaft hole within which the drive shaft is located. The shaft hole has an opening that opens adjacent to the projection. A recess is formed in the wall of the shaft hole adjacent to the opening. A hardening treatment is performed on the wall of the shaft hole and on the outer surface of the projection to improve wear resistance.

In a third aspect of the present invention, a method for hardening a metal plate is provided. The metal plate has first and second side surfaces, a through hole that passes through the metal plate, and a projection that projects from the first side surface adjacent to the through hole. The wall of the through hole and an outer surface of the projection are simultaneously hardened. The method includes the steps of enlarging the through hole in the vicinity of the outer surface of the projection with a recess, inserting a first conductive wire into the through hole, positioning a second conductive wire opposite the outer surface of the projection, heating the metal plate by eddy currents inducted in the metal plate by a high frequency current flowing through the first and second conductive wires, and quenching the heated metal plate.

Other aspects and advantages of the present invention will becomes apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

FIG. 7(*b*) is a rear view showing the swash plate of FIG. 7(*a*).

DETAILED DESCRIPTION OF THE PREFERRED EMBODIMENTS

A clutchless type variable displacement compressor according to a first embodiment of the present invention will now be described with reference to FIGS. 1 to 5.

Figure 1:
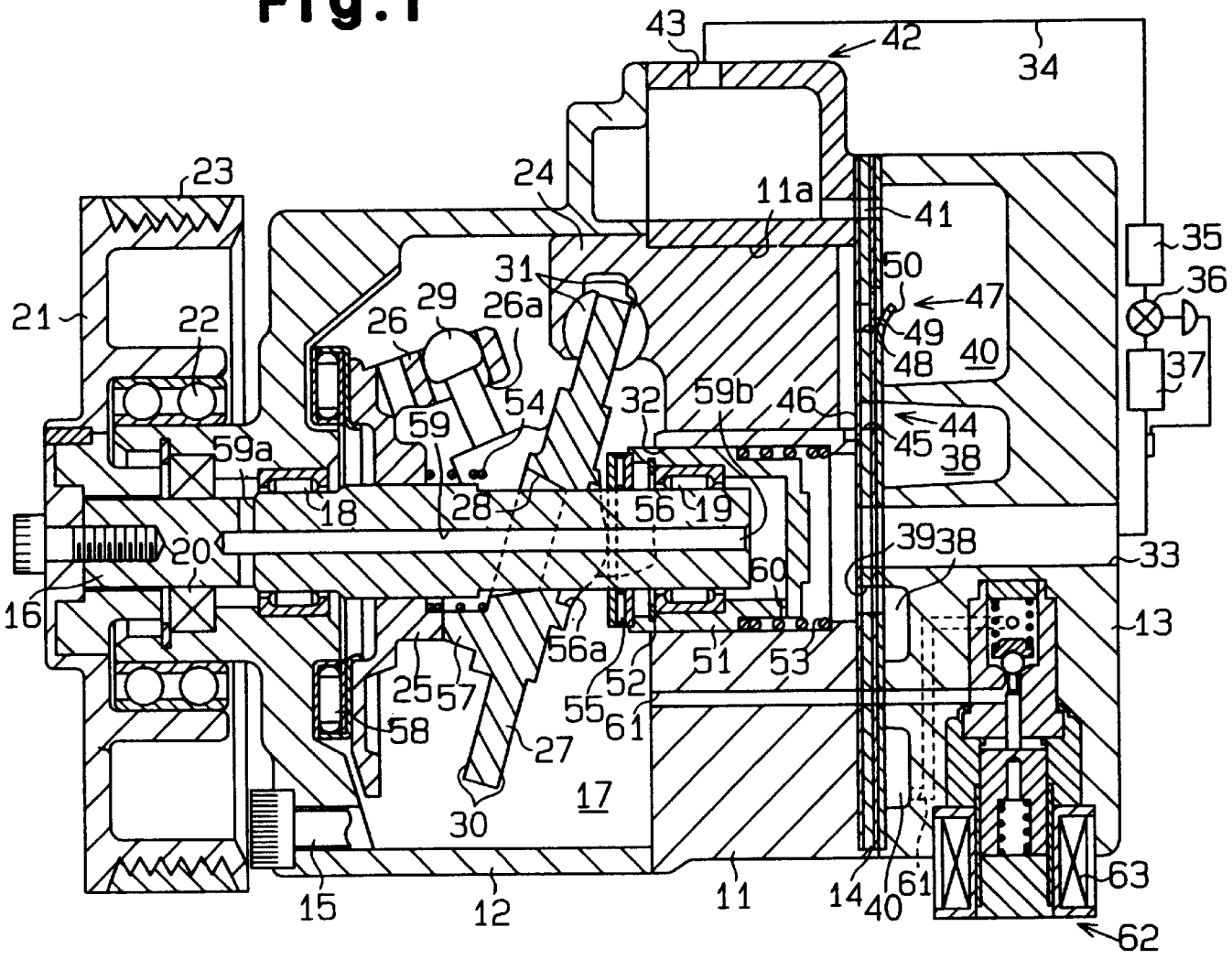
FIG. 1 is a cross-sectional view of a variable displacement compressor according to a first embodiment of the present invention.

As shown in FIG. 1, a front housing 12 is coupled to the front end of a cylinder block 11. A rear housing 13 is coupled to the rear end of the cylinder block 11 with a valve plate 14 held in between. The front housing 12, the cylinder block 11, and the rear housing 13 constitute a compressor housing. A plurality of bolts 15 (only one shown) fasten the front housing 12 and the rear housing 13 to the cylinder block 11. A gasket (not shown) is arranged between the front housing 12 and the cylinder block 11.

A crank chamber 17 is defined in the front housing 12 in front of the cylinder block 11. A drive shaft 16 extends through the crank chamber 17 and is rotatably supported by a pair of radial bearings 18, 19. A lip seal 20 seals the space between the front portion of the drive shaft 16 and the front housing 12. The front end of the drive shaft 16 extends outward from the crank chamber 17. A pulley 21 is fixed to the projecting end of the drive shaft 16. An angular bearing 22 supports the pulley 21 on the front housing 12. The front housing 12 receives the axial and radial load acting on the pulley 21 through the angular bearing 22. A belt 23 constantly and operably connects the pulley 21 to an automobile engine (not shown), which serves as an external drive source. Accordingly, the compressor of this embodiment is clutchless.

A plurality of equally spaced cylinder bores 11*a* (only one shown) extend through the cylinder block 11 about the drive shaft 16. A single-headed piston 24 is reciprocally accommodated in each cylinder bore 11*a*.

A rotor 25 is fixed to the drive shaft 16. A pair of support arms 26 project from the rotor 25 toward the cylinder block 11. A guide bore 26*a* extends through each support arm 26. A cam plate, or swash plate 27, having a hole 28 extending through its center is fitted on the drive shaft 16. The swash plate 27 inclines with respect to the drive shaft 16. The front and rear walls of the hole 28 are tapered so that the size of the hole 28 becomes larger at its outer positions at upper and lower areas, as shown in the rear view of FIG. 2. This allows the swash plate 27 to incline on the drive shaft 16. Two guide pins 29, each having a semi-spherical end, project from the front surface of the swash plate 27 (the side facing the rotor 25). Each guide pin 29 is rotatably and slidably fitted into the guide bore 26*a*. The cooperation between the support arms 26 and the guide pins 29 enables the swash plate 27 to incline and move in the axial direction of the drive shaft 16 while rotating integrally with the drive shaft 16.

A sliding surface 30 is defined on the peripheral portion of each side of the swash plate 27. Each piston 24 is coupled to the swash plate 27 by a pair of semi-spherical shoes 31 with each shoe 31 engaged with one of the sliding surfaces 30. The shoes 31 convert the rotation of the swash plate 27 to linear reciprocation of the pistons 24 in the associated cylinder bores 11*a*.

A central bore 32 concentric with the drive shaft 16 extends through the center of the cylinder block 11. A suction passage 33 extends through the rear housing 13 and the center of the valve plate 14. The front end of the suction passage 33 is connected with the central bore 32. The rear end of the suction passage 33 is connected to an external refrigerant circuit 34 through a suction muffler (not shown). The external refrigerant circuit 34 includes a condenser 35, an expansion valve 36, and an evaporator 37.

An annular suction chamber 38 is defined in the center portion of the rear housing 13. The suction chamber 38 is connected to the central bore 32 by an aperture 39. An annular discharge chamber 40 is defined in the peripheral portion of the rear housing 13. A discharge passage 41 connects the discharge chamber 40 to a discharge muffler 42, which is provided on the outer wall of the cylinder block 11 and front housing 12. The discharge muffler 42 has an outlet 43 that is connected with the external refrigerant circuit 34.

A suction valve mechanism 44 is provided in the valve plate 14 in correspondence with each cylinder bore 11*a*. Each suction valve mechanism 44 includes a suction port 45 and a suction flap 46. When each piston 24 is moved toward the rear in the associated cylinder bore 11*a* (toward the left as viewed in FIG. 1), refrigerant gas is drawn into the compression chamber of the cylinder bore 11*a* through the associated suction valve mechanism 44 from the suction chamber 38.

A discharge valve mechanism 47 is provided in the valve plate 14 in correspondence with each cylinder bore 11*a*. Each discharge valve mechanism 44 includes a discharge port 48 and a discharge flap 49. When each piston 24 is moved toward the front in the associated cylinder bore 11*a* (toward the right as viewed in FIG. 1), the refrigerant gas compressed in the compression chamber of the cylinder bore 11*a* is discharged into the discharge chamber 40 through the associated discharge valve mechanism 47. The opening angle of the discharge flap 48 is restricted by abutment against a retainer 50.

A cup-like spool 51 is slidably accommodated in the central bore 32. The radial bearing 19, which supports the rear end of the drive shaft 16, is fitted into the spool 51. A snap ring 52 prevents the radial bearing 19 from falling out of the spool 51. A first spring 53 is arranged between the spool 51 and the rear end of the central bore 32. The first spring 53 urges the spool 51 toward the swash plate 27 and opens the suction passage 33. A second spring 54 is arranged between the rotor 25 and the swash plate 27 to urge the swash plate 27 toward the cylinder block 11 and decrease the inclination of the swash plate 27 with respect to the drive shaft 16. The spring constant of the first spring 53 is smaller than the spring constant of the second spring 54. The resultant force of the urging forces of the first and second springs 53, 54 urges the swash plate 27 toward the rear. A thrust bearing 55, which is a roller bearing, is slidably fitted on the drive shaft 16 between the spool 51 and the swash plate 27.

Figure 2:
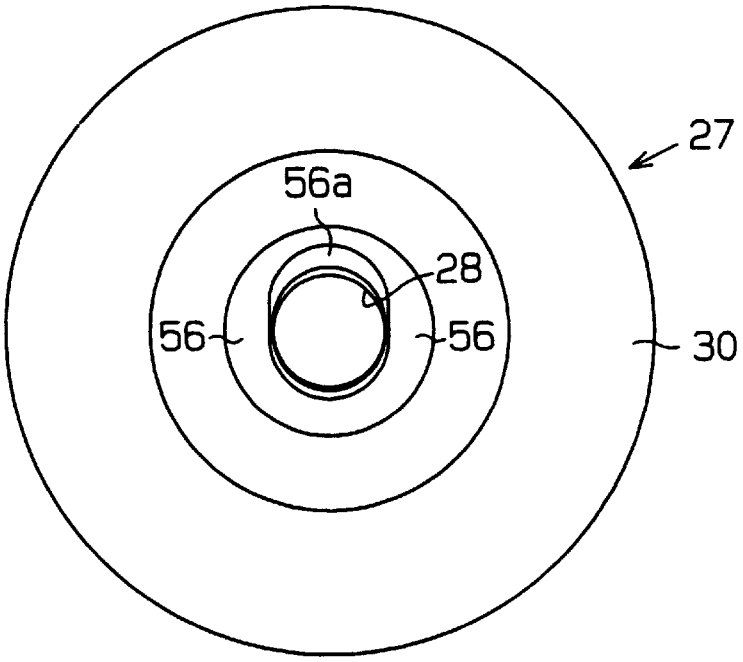
FIG. 2 is a rear view of the swash plate of FIG. 1.
Figure 3:
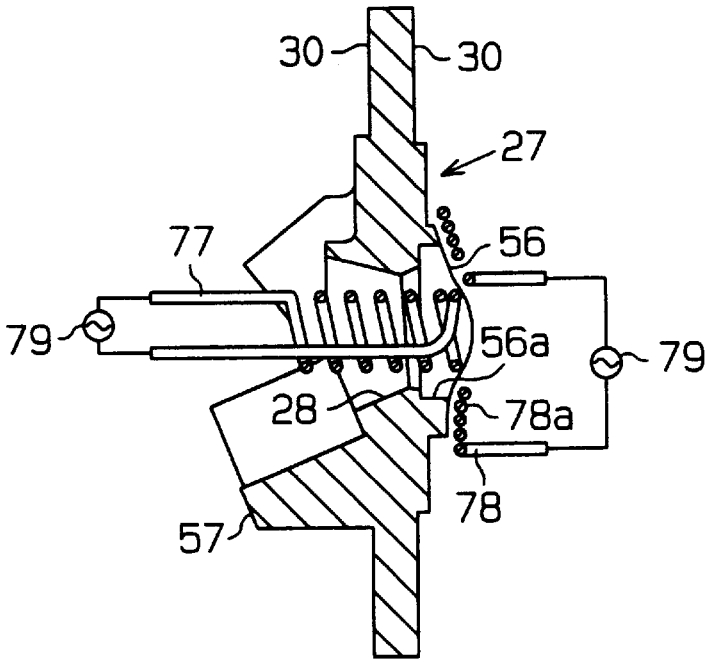
FIG. 3 is a schematic cross-sectional view showing the position of a coil during induction hardening of the swash plate.

As shown in FIGS. 1 to 3, two projections 56 extend from the rear surface of the swash plate 27, one on each side of the vertical plane that cuts FIG. 1. The end surfaces of the projections 56 are rounded, and each has a cross-section that is bounded by a predetermined curve. In the preferred and illustrated embodiment, the projections 56 are generally semi-cylindrical. This positively abuts the end surfaces of the projections 56 against the front race of the thrust bearing 55 regardless of the inclination of the swash plate 27. The axial load acting on the spool 51 when the swash plate 27 inclines and rotates is received by the thrust bearing 55. The swash plate hole 28 extends between the projections 56. The hole 28 includes an oblong counterbore to define a recess 56*a* at the end of the hole 28 that faces the cylinder block 11. The end surfaces of the projections 56 and the wall surface of the hole 28 are hardened by induction hardening.

When the swash plate 27 is shifted to a minimum inclination position, the spool 51 is moved toward the rear against the force of the first spring 53. This causes the spool 51 to close the suction passage 33 and impedes the flow of refrigerant gas from the external refrigerant circuit 34 to the suction chamber 38. When arranged at the minimum inclination position, the angle of the swash plate 27 with respect to a plane perpendicular to the axis of the drive shaft 16 is slightly greater than zero degrees. As the spool 51 reaches the closing position, the spool 51 restricts the swash plate 27 from inclining beyond the minimum inclination position.

When the swash plate 27 is shifted to a maximum inclination position, the spool 51 is moved toward the front against the force of the first spring 53. This separates the spool 51 from the front end of the suction passage 33 and permits the refrigerant gas in the external refrigerant circuit 34 to flow into the suction chamber 38 through the suction passage 33. With the swash plate 27 located at the maximum inclination position, the displacement of the compressor is at a maximum level. The abutment between the front surface of the swash plate 27 and a restricting projection 57 prevents the swash plate 27 from inclining beyond the maximum inclination position.

A thrust bearing 58 is arranged between the rotor 25 and the front housing 12. The thrust bearing 58 receives a reaction force that is transmitted to the rotor 25 from the cylinder bores 11*a*, the pistons 24, the shoes 31, the swash plate 27, and the guide pins 29.

A conduit 59 extends through the drive shaft 16. The conduit 59 has an inlet 59*a*, which is located at the vicinity of the lip seal 20, and an outlet 59*b*, which is connected with the interior of the spool 51. A pressure releasing hole 60 is provided in the wall of the spool 51. The pressure releasing hole 60 connects the interior of the spool 51 to the central bore 32.

A pressurizing passage 61 connects the discharge chamber 40 and the crank chamber 17. In the rear housing 13, an electromagnetic valve 62, which functions as a displacement control valve, is provided in the pressurizing passage 61. When the electromagnetic valve 62 is opened, the pressure in the discharge chamber 40 is released into the crank chamber 17 through the pressurizing passage 61. Thus, the electromagnetic valve 62 adjusts the pressure in the crank chamber 17.

The induction hardening treatment performed on the wall surface of the swash plate hole 28 and the end surfaces of the swash plate projections 56 will now be described. As shown in FIG. 3, during hardening, a first coil 77 is used to harden the wall surface of the hole 28, while a second coil 78 is used to harden the surfaces of the projections 56. The first coil 77 extends helically about its axis and is inserted into the hole 28 from the opposite side of the swash plate 27 from the projections 56 so that the coil 77 is concentric with the hole 28. The first coil 77 is inserted into the hole 28 until its distal end passes by the recess 56*a* and is flush with the end surfaces of the projections 56. However, the first coil 77 may be further inserted so that its distal end extends beyond the end surfaces of the projections 56. The proximal end of the first coil 77 extends from the front side of the hole 28.

Figure 4:
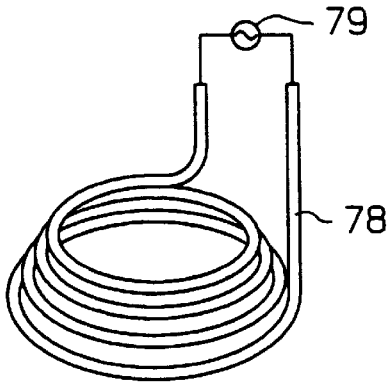
FIG. 4 is a schematic perspective view showing the coil.

As shown in FIG. 3, the second coil 78 extends semi-cylindrically in conformance with the rounded end surfaces of the projections 56. The second coil 78 is arranged so that each of its windings 78*a* extends along the end surfaces of the projections 56. FIG. 4 shows a conical version of the second coil 78, where the spaces between the windings 78a are exaggerated. The shape of the second coil 78 may vary as long as it approximately conforms to the shape of the projections 56. As shown in FIG. 3, the windings 78*a* are spaced apart from one another by predetermined intervals. When the second coil 78 is placed adjacent to the projections 56, the innermost winding 78*a* is located radially inward of the recess 56*a*. The outermost winding 78*a* is located radially outward of the periphery of the projections 56.

An electric power source 79 supplies the first and second coils 77, 78 with electric current having a predetermined high frequency. The current flows through the coils 77, 78 for a predetermined time. The current causes electromagnetic induction and produces eddy currents at the wall of the hole 28 and at the end surfaces of the projections 56. This generates Joule heat and heats the wall of the hole 28 and the end surfaces of the projections 56. Afterward, the swash plate 27 is quenched by using a coolant. This completes the hardening treatment. Oil or water may be used as the coolant.

In this embodiment, the swash plate 27 is provided with the recess 56*a*, which is located at the rear portion of the hole 28. That is, the recess 56*a* is located at the location affected by the heat generated by the first coil 77 and the heat generated by the second coil. This structure prevents excessive heating of the surface of the hole 28 where the heat generated by both the coils 77, 78 acts. Unlike the induction hardening performed in the prior art, the structure of the present invention prevents the surfaces that undergo the hardening treatment from being over-heated. Hence, melting or cracking of the wall of the hole 28 does not take place. Furthermore, deformation of the hole 28 does not occur during heat treatment.

Figure 5:
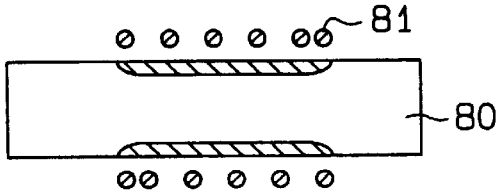
FIG. 5 is a diagrammatic cross-sectional view showing the relationship between the position of induction coils and the heated areas of a section of material.

Generally, the heating level of eddy currents is determined by the distance between the coil and the heating material, or the position of the coil with respect to the heating material. As shown in FIG. 5, when a heating material 80 is heated by a coil 81, the heated portion of the material 80 includes only the surface facing toward the coil 81 (as indicated by the cross hatching lines). Furthermore, at locations corresponding to the ends of coil 81 in the heated portion, the heating level, or heating depth, is more shallow than that of locations corresponding to the middle part of the coil 81. This relationship is the same even if the coil is arranged within the heated material. Thus, the heating of the ends of the hole 28 may be insufficient if the axial length of the first coil 77 is the same as the axial length of the portion of the hole 28 that requires hardening. However, the distal portion of the first coil 77 extends to a position corresponding to the recess 56*a* while the proximal portion of the first coil 77 projects out of the hole 28. This sufficiently heats the portion of the hole 28 that requires hardening.

In addition, the second coil 78 is large enough to encompass the end surfaces of the projections 56 that require hardening. This sufficiently heats the portion of the projections 56 that requires hardening.

The operation of the above compressor will now be described.

When the external drive source is driven, the rotor 25 is rotated by the drive shaft 16. This reciprocates the pistons 24 with a stroke corresponding to the inclination of the swash plate 27. The reciprocation of each piston 24 draws the refrigerant gas in the suction chamber 38 into the compression chamber of the associated cylinder bore 11*a* through the suction port 45. The refrigerant gas is compressed to a predetermined pressure in the compression chamber and then discharged into the discharge chamber 40 through the discharge port 48. The compressed refrigerant gas discharged into the discharge chamber 40 is then sent to the external refrigerant circuit 34 by way of the discharge passage 41 and the discharge muffler 42.

In the state shown in FIG. 1, the solenoid 63 is excited and the pressurizing passage 61 is closed by the electromagnetic valve 62. Thus, the high pressure refrigerant gas in the discharge chamber 40 is not communicated to the crank chamber 17 through the pressurizing passage 61. Only the refrigerant gas in the crank chamber 17 is communicated to the suction chamber 38 through the conduit 59 and the pressure releasing hole 60. Accordingly, the pressure of the crank chamber 17 decreases and approaches the low pressure of the suction chamber 38 (suction pressure). This holds the swash plate 27 at the maximum inclination position and causes the displacement of the compressor to become maximum.

When the suction pressure changes in correspondence with the cooling loading, the difference between the pressure of the crank chamber 17 and the suction pressure alters the inclination of the swash plate 27. This alters the stoke of the pistons 24 and adjusts the displacement of the compressor. As the cooling load becomes small when the swash plate 27 is located at the maximum inclination position, the temperature of the evaporator 37 in the external refrigerant circuit 34 decreases. As the temperature of the evaporator 37 becomes lower than the temperature at which frost forms, the solenoid 63 is de-excited and the electromagnetic valve 62 is opened. This communicates the high pressure refrigerant gas in the discharge chamber 40 to the crank chamber 17 through the pressurizing passage 61 and increases the pressure in the crank chamber 17. As a result, the swash plate 27 is shifted to the minimum inclination position from the maximum inclination position.

As the inclination of the swash plate 27 decreases, the thrust bearing 55 applies a rearward moving force to the spool 51. The spool 51 moves from the forward opening position to the rearward closing position against the force of the spring 53. When the swash plate 27 is located at the minimum inclination position, the spool 51 is located at the closing position with the rear surface of the spool 51 closing the outlet of the suction passage 33. This impedes the flow of refrigerant gas from the external refrigerant circuit to the suction chamber 38.

The inclination of the swash plate 27 when arranged at the minimum inclination position is slightly greater than zero degrees. Thus, the discharge of refrigerant gas from the cylinder bores 11*a* to the discharge chamber 40 is continued even if the swash plate 27 is located at the minimum inclination position. The refrigerant gas discharged into the discharge chamber 40 flows into the crank chamber 17 through the pressurizing passage 61. The refrigerant gas then passes through the conduit 59, the interior of the spool 51, the pressure releasing hole 60, and finally reaches the suction chamber 38. Then, the refrigerant gas in the suction chamber 38 is again drawn into the compression chamber of the cylinder bores 11*a* and discharged into the discharge chamber 40.

In other words, when the swash plate 27 is located at the minimum inclination position, a circulation passage is defined in the compressor. The circulation passage extends through the discharge chamber 40, the pressurizing passage 61, the crank chamber 17, the conduit 59, the pressure releasing hole 60, the central bore 32, the aperture 39, the suction chamber 38, and the cylinder bores 11*a*. Refrigerant gas circulates through the circulation passage and lubricates portions of components that contact other components with the lubricating oil suspended in the gas.

When the operation of the external drive source is stopped, the operation of the compressor is also stopped. This stops the flow of current to the solenoid 63 of the electromagnetic valve 62. Consequently, the pressurizing passage 61 is opened and the force of the second spring 54 shifts the swash plate 27 to the minimum inclination position.

The projections 56 are always in contact with the thrust bearing 55, while part of the wall of the hole 28 always contacts the drive shaft 16. Thus, when the inclination of the swash plate 27 is altered to vary the displacement of the compressor, friction is produced at the contacting portions. Furthermore, the swash plate 27 is rotated with the projections 56 contacting the thrust bearing 55. However, due to the hardening of the wall of the hole 28 and the surfaces of the projections 56, abrasion of the contacting surfaces is reduced. This prolongs the life of the compressor.

The advantageous effects of this embodiment will now be described.

The projections 56 are provided with the recess 56*a*, which is located at the rear opening of the hole 28. This structure causes the wall of the hole 28 and the end surfaces of the projections 56 to be hardened without any cracks, melting, or deformation. As a result, the anti-abrasion characteristic of the swash plate 27 is improved and the life of the compressor is extended.

The hardening treatment is performed by using high frequency current (induction hardening). Thus, the hardening treatment is facilitated in comparison with flame hardening.

When performing induction hardening, the first coil 77 is used to harden the wall of the hole 28, while the second coil 78 is used to harden the end surfaces of the projections 56. Furthermore, the recess 56*a* is provided at the rear opening of the hole 28. Accordingly, the heating effect of the coil 77 and the heating effect of the coil 78 do not overlap with each other. Thus, excessive heating is prevented and the desired portions are heated optimally. This results in improved hardening. Furthermore, high frequency current flows separately through the coils 77, 78. This enables the current value, the current frequency, and the energized time of the coils 77, 78 to be set independently. Thus, heat treatment is conducted at optimal conditions.

During hardening, the first coil is inserted through the hole 28 so that the distal end of the first coil 77 is located at an axial position corresponding to the recess 56*a*, while the proximal end of the first coil 77 projects from the hole 28. Furthermore, the second coil 78 faces toward the end surfaces of the projections 56 so that the second coil 78 encompasses the portions of the projections 56 that require hardening. Accordingly, the portions that require hardening are sufficiently heated and hardened in an improved manner.

The first coil 77 heats the wall of the hole 28 while the second coil 78 heats the end surfaces of the projections 56. This shortens the heating time in comparison to when the heating of the hole 28 and the heating of the projections 56 are carried out separately. As a result, the total time required during heat treatment is reduced.

It should be apparent to those skilled in the art that the present invention may be embodied in many other specific forms without departing from the spirit or scope of the invention. Particularly, it should be understood that the invention may be embodied in the following forms.

(1) A flat spiral coil may be used instead of the second coil 78, which is semi-cylindrical so as to conform with the surface of the projections 56. Furthermore, the coil 78 need not be circular and may have other forms. For example, the coil 78 may be square or hexagonal.

Figure 6:
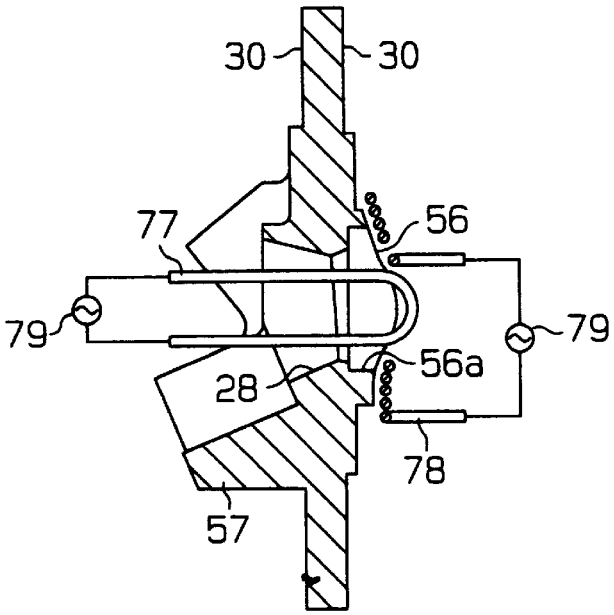
FIG. 6 is a schematic cross-sectional view showing the position of a coil in a further embodiment of the present invention.
Figure 7B:
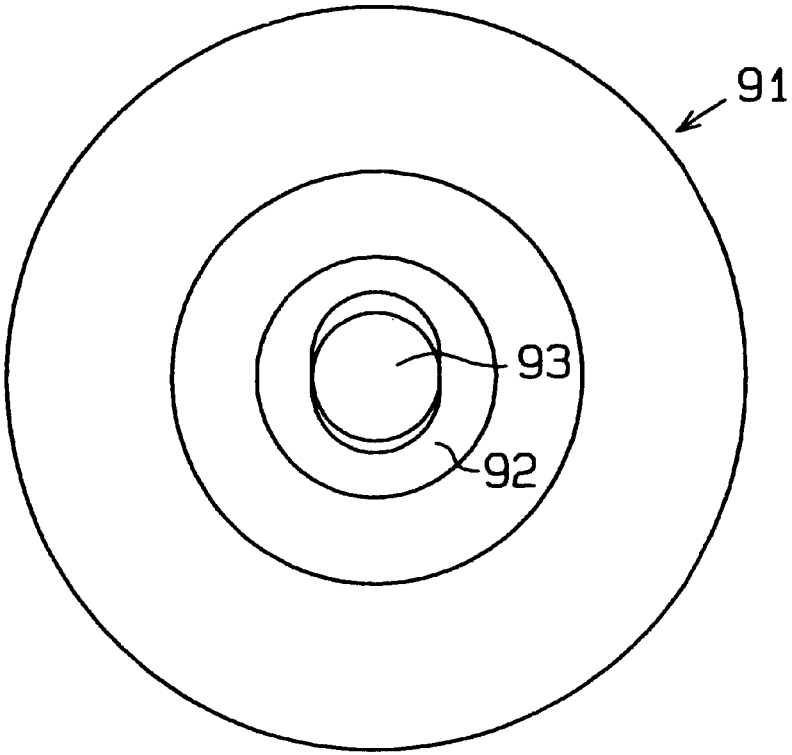
Fig.7(b) (Prior Art)
FIG. 7(*a*) is a schematic cross-sectional view showing the position of the coil during induction hardening of a swash plate in the prior art.
Figure 7A:
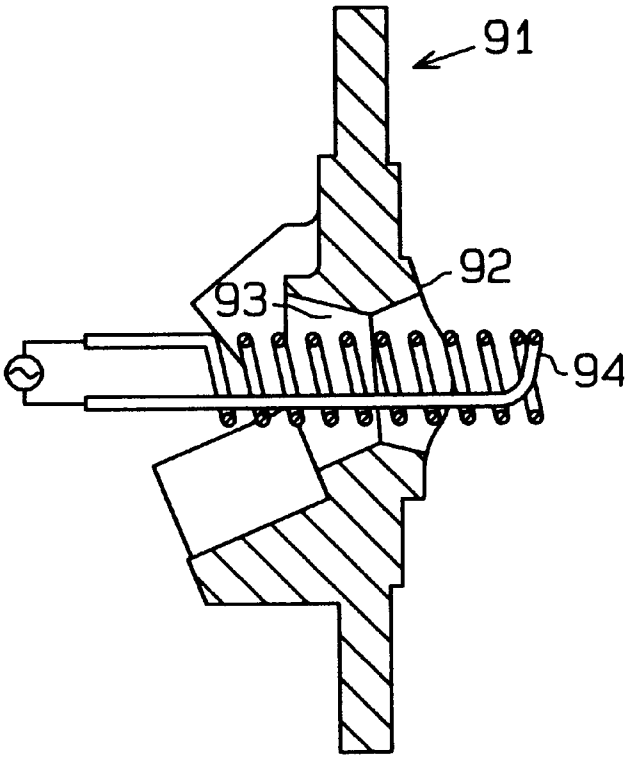
Fig.7(a) (Prior Art)

(2) A hairpin-like coil, such as that shown in FIG. 6, may be used in lieu of the helical first coil 77. In this case, the wall of the hole 28 is heated while rotating the swash plate 27. This simplifies the structure of the first coil 77.

(3) In the embodiment of FIG. 6, a coil having a heating area smaller than the area of the projection that requires hardening may be arranged to face a portion of the projections 56. In this state, the swash plate 27 is rotated to heat all of the end surfaces of the projections 56. This structure permits the use of a smaller second coil 77.

(4) A coil that is axially shorter than the axial length of the wall of hole 28 may be used as the first coil 77. In this case, heat treatment is conducted by moving the first coil 77 relative to the hole 28. To perform relative movement, the first coil 77 may be moved alone, or the swash plate 27 may be moved alone, or both may be moved together. It is preferable that the relative movement be carried out so that the first coil 77 face toward each portion of the wall of the hole 28 for substantially the same length of time.

(5) In the first embodiment and the embodiment of FIG. 6, the first coil 77 and the second coil 78 may be formed integrally with each other. In this case, the integral coil is inserted into the hole 28 from the projection side. Since only one coil is necessary, the number of parts is reduced. This facilitates the heat treatment.

(6) In each of the above embodiments, a copper pipe may be used in lieu of the coil. The copper pipe is energized while coolant flows through the pipe. In this case, a current having a larger value flows through the copper pipe while the pipe is cooled. This shortens the heating time.

(7) In the first embodiment and the embodiments described in paragraphs (1) to (5), a copper pipe having a plurality of holes may be used in lieu of the coil. Coolant used for quenching is injected from the holes. After a high frequency current flows through the copper pipe for a predetermined time, coolant is injected through the holes toward portions of the swash plate 27 that require quenching. Water or oil may be used as the coolant. In this case, the heated portions of the swash plate 27 may be quenched without removing the copper pipe.

(8) The thrust bearing 55 may be replaced by a plane bearing, or a sliding bearing.

(9) The second spring 54 that urges the swash plate 27 toward the minimum inclination position may be eliminated. In this case, the swash plate 27 is shifted toward the minimum inclination position only by the pressure increase in the crank chamber 17 when the operation of the compressor is stopped. This structure would decrease the weight of the compressor and reduce production costs.

(10) The present invention may be applied to a compressor having a bleeding passage connecting the crank chamber 17 and the suction chamber 38 and a control valve provided in the bleeding passage to change the pressure of the crank chamber 17. The durability of the swash plate 27 is also improved by the application of the present invention and the life of the compressor is thus prolonged.

Therefore, the present examples and embodiments are to be considered as illustrative and not restrictive and the invention is not to be limited to the details given herein, but may be modified within the scope and equivalence of the appended claims.

What is claimed is:

1. A variable displacement type compressor having a piston accommodated in a cylinder bore, a cam plate accommodated in a crank chamber for reciprocating the piston and a drive shaft for tiltably and rotatably supporting the cam plate, wherein the compressor performs suction of a gas from a suction chamber, compression of the gas in the cylinder bore and discharging of the gas to a discharge chamber in accordance with a reciprocation of the piston, and wherein the compressor changes a discharge amount of the gas by changing the inclination angle of the cam plate based on pressure differences between the pressure in the crank chamber and the pressure in the cylinder bore, the compressor comprising:

a passage for introducing the gas to the suction chamber;

a spool movably supported on the drive shaft for selectively opening and closing the passage;

a spring for urging the spool toward the bearing in a direction where the spool opens the passage; and a thrust bearing located about the drive shaft for receiving a load from the cam plate, wherein the thrust bearing moves together with the spool;

wherein the cam plate includes:

a projection that extends toward the thrust bearing, wherein the projection has an abutment surface that contacts the thrust bearing;

a shaft hole within which the drive shaft is located, the shaft hole having an opening that opens adjacent to the projection; and a recess formed in the wall of the shaft hole adjacent to the opening;

wherein a hardening treatment is performed on the wall of the shaft hole and on the outer surface of the projection to improve wear resistance.

2. The compressor according to claim 1, wherein the hardening treatment is performed by using high frequency electrical current.

3. The compressor according to claim 1, wherein the projection has a rounded outer surface.

4. A variable displacement type compressor having a piston accommodated in a cylinder bore formed in a casing, a cam plate accommodated in a crank chamber for reciprocating the piston and a drive shaft for tiltably and rotatably supporting the cam plate, wherein the compressor performs suction of a gas from a suction chamber, compression of the gas in the cylinder bore and discharging of the gas to a discharge chamber in accordance with a reciprocation of the piston, and wherein the compressor changes a discharge amount of the gas by changing the inclination angle of the cam plate based on pressure differences between the pressure in the crank chamber and the pressure in the cylinder bore, the compressor comprising:

a passage for introducing the gas to the suction chamber;

a spool movably supported in the casing for selectively opening and closing the passage;

first and second radial bearings for supporting the drive shaft, the first radial bearing being mounted in the casing, and the second radial bearing being mounted in the spool;

a thrust bearing provided on the drive shaft between the cam plate and the spool for receiving a load from the cam plate;

a first spring for urging the spool toward the thrust bearing in a direction where the spool opens the passage; and a second spring for urging the cam plate toward the spool;

wherein the cam plate includes:

a projection that extends toward the thrust bearing, wherein the projection has an abutment surface that contacts the thrust bearing;

a shaft hole within which the drive shaft is located, the shaft hole having an opening that opens adjacent to the projection; and a recess formed in the wall of the shaft hole adjacent to the opening;

wherein a hardening treatment is performed on the wall of the shaft hole and on the outer surface of the projection to improve wear resistance.

5. The compressor according to claim 4, wherein the hardening treatment is performed by using high frequency electrical current.

6. The compressor according to claim 4, wherein the projection has a rounded outer surface.

7. A cam plate for a compressor having a drive shaft, the cam plate being supported tiltably on the drive shaft for reciprocating a piston in accordance with a rotation of the drive shaft and a thrust bearing for receiving a load from the cam plate, the cam plate including:

a projection that extends toward the thrust bearing, wherein the projection has an abutment surface that contacts the thrust bearing;

a shaft hole within which the drive shaft is located, the shaft hole having an opening that opens adjacent to the projection; and a recess formed in the wall of the shaft hole adjacent to the opening;

wherein a hardening treatment is performed on the wall of the shaft hole and on the outer surface of the projection to improve wear resistance.

8. The cam plate according to claim 7, wherein the hardening treatment is performed by using high frequency electrical current.

9. The cam plate according to claim 7, wherein the outer surface of the projection is generally semi-cylindrical.

* * * * *